US006065266A

United States Patent [19]

Behr et al.

[11] Patent Number: 6,065,266

[45] Date of Patent: May 23, 2000

[54] LIGHT STRUCTURAL METAL PLATE IN THE FORM OF A HUMP PLATE AND PROCESS FOR ITS PRODUCTION

[75] Inventors: Friedrich Behr, Krefeld; Klaus Blümel, Dinslaken; Hans Pircher, Mülheim/Ruhr, all of Germany

[73] Assignee: Thyssen Stahl AG, Duisburg, Germany

[21] Appl. No.: 09/114,764

[22] Filed: Jul. 14, 1998

[30] Foreign Application Priority Data

Jul. 17, 1997 [DE] Germany ..... 197 30 647

[51] Int. Cl.[7] ..... E04C 2/32; E04C 2/38

[52] U.S. Cl. ..... 52/630; 52/789.1; 52/794.1; 52/783.11; 52/783.19; 428/653; 428/594; 428/603; 404/18; 404/21; 404/34

[58] Field of Search ..... 52/630, 789.1, 52/794.1, 783.11, 783.19; 404/18, 21, 34, 35, 43, 73, 82; 428/653, 594, 603

[56] References Cited

U.S. PATENT DOCUMENTS

| | | | |
|---|---|---|---|
| 963,889 | 7/1910 | Goodwin | 52/789.1 |
| 2,302,949 | 11/1942 | Palmer | 52/630 |
| 2,391,997 | 1/1946 | Noble | 52/789.1 |
| 2,699,599 | 1/1955 | Potchen | 52/630 |
| 3,196,763 | 7/1965 | Rushton | 52/789.1 |
| 3,292,256 | 12/1966 | Morgan | 428/653 |
| 3,507,634 | 4/1970 | O'Driscoll | 52/789.1 |
| 4,005,991 | 2/1977 | Uebayasi et al. | 428/594 |
| 4,203,268 | 5/1980 | Gladden, Jr. et al. | 52/630 |
| 4,274,483 | 6/1981 | Cottone et al. | 428/653 |
| 4,411,121 | 10/1983 | Blacklin et al. | 52/630 |
| 4,454,823 | 6/1984 | Stoller, Sr. et al. | 428/653 |
| 4,603,089 | 7/1986 | Bampton | 428/653 |
| 5,115,621 | 5/1992 | Kobayashi | 52/630 |
| 5,244,745 | 9/1993 | Seksaria et al. | 52/789.1 |
| 5,487,329 | 1/1996 | Fissler | 428/653 |
| 5,506,062 | 4/1996 | Flammang | 428/653 |
| 6,002,098 | 12/1999 | Pircher et al. . | |

FOREIGN PATENT DOCUMENTS

| | | |
|---|---|---|
| 19502140C | 5/1996 | Germany . |
| 19503166A | 8/1996 | Germany . |
| 19640612C | 6/1998 | Germany . |

OTHER PUBLICATIONS

Technische Mitteilung Krupp—Worksbericht (Krupp Technical Information, Works Report), vol. 32, (1974), No. 1, H. Sedlacek (Plattenprogramm von Krupp Industries), pp. 1–14.

*Primary Examiner*—Carl D. Friedman
*Assistant Examiner*—Dennis L. Dorsey
*Attorney, Agent, or Firm*—Proskauer Rose LLP

[57] ABSTRACT

The invention relates to a light structural steel plate in the form of a hump plate and to a process for its production. The light structural steel plate comprises a mould-pressed steel hump plate (1) and a flat aluminium plate (3) connected thereto substance-to-substance at a the hump end faces. The substance-to-substance connection is produced by the feature that after the surfaces to be interconnected at the hump end faces have been activated by means of a laser beam (5), said surfaces are metallically connected under pressure. The decisive factor is that the material of the plates (1, 2) does not pass into the molten phase during activation by means of the laser beam (5).

13 Claims, 3 Drawing Sheets

LIGHT STRUCTURAL METAL PLATE IN THE FORM OF A HUMP PLATE AND PROCESS FOR ITS PRODUCTION

BACKGROUND OF THE INVENTION

The invention relates to a light structural metal plate in the form of a hump plate comprising a mould-pressed hump plate and a flat plate connected thereto substance-to-substance at the hump end faces.

Various forms of light structural metal plates are known, more particularly in the form of hollow compartment plates and hump plates. Hollow compartment and hump plates consist of outer cover plates and the most variously constructed spacers disposed therebetween. In dependence on the load exerted, in such light structural plates one outer cover plate acts as a tension chord, the other acting as a compression chord. In comparison with solid plates, such light structural plates have higher flexural and buckling strengths for the same weight per unit of area. For this reason they are used as supporting structural elements for floor or roadway plates to be walked or driven over, but they are also employed for walls.

Prior art aluminium or steel hollow compartment plates (Krupp Technical Information, Works Reports, Vol. 32 (1974), No. 1, pp. 1–14, more particularly pp. 5–6) consist of outer cover plates and continuous webs, disposed therebetween as spacers, which extend in only one direction and are rigidly connected to the cover plates. In one aluminium hollow compartment plate the cover plate and the webs are extruded in one piece. In one steel hollow compartment plate the webs are formed by trapezoidal plates bent in zig-zag shape and welded to the cover plates. It is true that such aluminium or steel hollow compartment plates have high flexural strength in the longitudinal direction of the webs, but low flexural strength transversely of the longitudinal direction of the webs. Since their buckling strength is therefore not particularly high, they are unsuitable to be used as surface supporting agents.

Other prior art steel or aluminium hump plates (Krupp Technical Information, Works Reports, Vol. 32 (1974), No. 1, pp. 1–14, more particularly pp. 2–3) are characterised in that they consist exclusively of two interconnected cover plates, at least one of which takes the form of a hump plate. The hump plate can be connected at the hump end faces to a similar hump plate or else to a flat plate. The advantage of such a hump plate is that it has the same buckling strength in all directions. However, the ratio between its weight and flexural strength and buckling strength is unfavourable.

It is an object of the invention to provide a light structural metal plate which takes the form of a hump plate which has a low weight per unit of surface, accompanied by satisfactory flexural strength in the x and y direction of the plane of the plate and also satisfactory buckling strength.

SUMMARY OF THE INVENTION

This problem is solved in a light structural plate of the kind specified by the feature that the flat plate is of aluminium and the hump plate of steel, and the substance-to-substance connection is a metallic connection produced by heat without a molten phase and having a shear strength of more than 15 $N/mm^2$.

The light structural plate according to the invention utilises the advantages specific to the materials aluminium and steel to arrive at a light structural plate which has improved flexural strength and buckling strength in relation to its weight per unit of area in comparison with conventional exclusively steel or exclusively aluminium light structural plates. If the light structural plate is loaded from the side of the flat plate, the surface inertia of the flat plate is decisive for resistance to buckling. The surface inertia is higher in proportion to the increasing thickness of the flat plate. The use of a flat aluminium plate is therefore advantageous, since it can be substantially thicker than a flat steel plate for the same weight per unit of area. As a result, the light structural plate according to the invention buckles only under substantially heavier loads than a light structural plate of the same weight per unit of area with a steel cover plate as pressure chord, which buckles between the connecting points. In the light structural plates according to the invention, therefore, the hump spacing can be approximately 6 times greater than that in exclusively steel hump plates, something which leads to the reinforcement of the tension chord, accompanied by an overall higher surface inertia. Less material is therefore pressed out of the steel plate for the formation of the humps, and the number and area of the required connecting places are kept comparatively small. Due to the small surface occupied by the humps in the overall surface of the hump plate, there is no substantially adverse effect on the tensional capacity of the hump plate in comparison with a flat plate. Since in the aforementioned loading the steel hump plate is subject to tensile stressing, and steel has a very much higher modulus of elasticity than aluminium, a higher buckling strength is ensured in the light structural plate according to the invention in comparison with a light structural plate made exclusively from aluminium. Due to the good deformability and high modulus of elasticity of steel, the mould pressing of the humps also causes no problems. The special combination of the different materials aluminium and steel at the hump end faces also ensures that the flat sheet and the hump sheet remain permanently connected rigidly and firmly to one another without adverse effect on the properties of the materials.

The strength of the connection between steel and aluminium can be further improved in various ways. In one feature of the invention the steel hump plate is galvanised at least on its connection side. This also prevents so-called crack corrosion. Alternatively or additionally the connection can also be positive. More particularly the positive connection can be formed by interengaging parallel grooves and ribs of the sheets.

In a preferred embodiment of the invention the humps have a trapezoidal cross-section and a greater length than width. To increase the rigidity of the light structural plate and for sound reduction purposes the cavity between the plates can be filled with a dimensionally stable filling material. Preferably use is made of cellular materials or hollow members with plastics binding.

The following dimensions are preferred for the light structural plate: For the aluminium and steel plate thicknesses the values are: $t_{st} \geqq \frac{1}{4}\, t_{al}$, preferably $t_{st} = \frac{1}{3}$ to $1.\frac{3}{3}\, t_{al}$. These ratios are advantageous for light structural walls resistant to buckling. To produce fanning-out in rectangular frame constructions, use can also be made of a larger steel plate thickness than $1.\frac{3}{3}\, t_{al}$. In that case with elongate humps the longitudinal axis of the humps should extend in the direction of the smaller frame distance. The ratio between the connected surface (hump end face) and the overall surface should be 5–13%.

The distance apart a of the humps at half the height should be 8–12 times the distance of the plates h. Also according to the invention the distance apart $\mathbf{1}_{x,y}$ of the hump centres in the direction of the x and y axes is $\mathbf{1}_{x,y} \leqq 45.\ t_{al} + D_{x,y}$ more particularly with 30. $t_{al}$.+$D_{x,y}$≦where $t_{al}$=material thickness of the flat plate and $D_{x,y}$=length and width of the hump end face in the direction of the x and y axes.

The invention also relates to a process for the production of a light structural plate according to the invention.

Such a process is characterised according to the invention by the features that the steel hump plate and the aluminium flat plate are activated, but not melted by heating with laser radiation locally limited to the surface area to be connected at the hump end faces, and in this state the two plates are metallically connected to one another by pressure. The connection under pressure is preferably performed by roller joining, as is known per se (DE 19 502 140 C1), but which more particularly forms the subject matter of an earlier German Patent Application (19 640 612.9-45).

In addition to the substance-to-substance connection, a positive connection can be effected by the plastic deformation of the flat aluminium sheet. More particularly, when the hump end faces are connected to the flat aluminium plate, ribs are formed in the hump end faces and impress themselves into the flat plate.

An embodiment of the invention will now be explained in greater detail with reference to the drawings, in which like reference numerals designate the same elements.

DETAILED DESCRIPTION OF THE INVENTION

Figure 1:
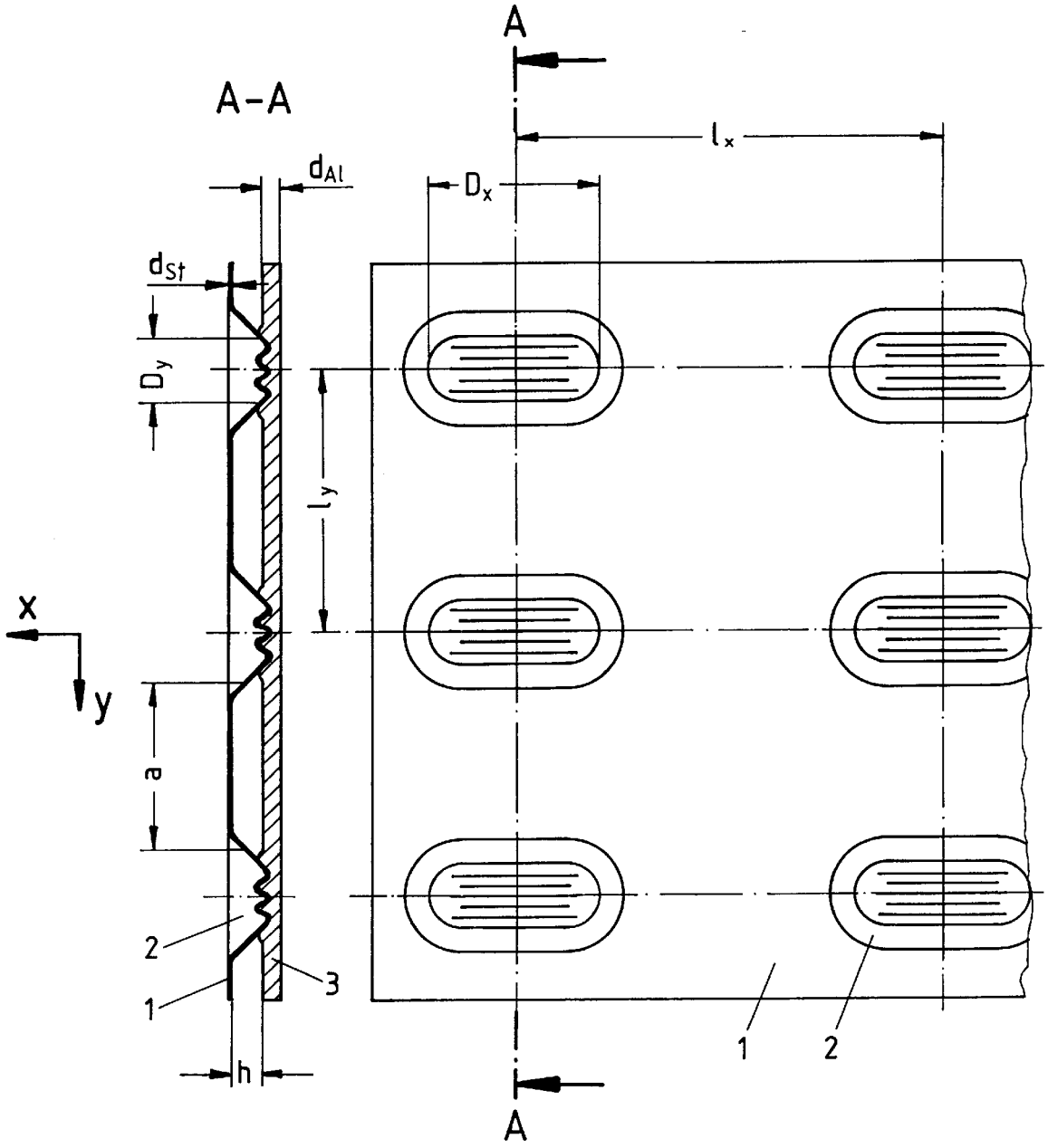
FIG. 1 depicts a light structural plate, on the right in elevation from side 1 of the hump plate, and on the left sectioned along the line A—A in the right-hand part of the drawing.

Referring to FIG. 1, a light structural plate comprises a steel hump plate 1 having a plurality of distributed elongate humps 2, oval in plan and trapezoidal in cross-section, and a flat aluminium plate 3. Preferably the hump plate 1 is galvanised on its side adjacent the flat plate 3. There is a substance-to-substance and positive connection between the hump end faces and the flat plate 3. The positive connection, i.e. form engagement, is produced by the interengagement of ribs and grooves of the hump end faces and the flat plate 3, the outside of the flat plate 3 remote from the hump plate 1 being flat. The hump end faces have a length $D_x$ and a width $D_y$. The distances between the centres of adjacent humps in the direction of the x axis are $\mathbf{1}_x$ and in the direction of the y axis $\mathbf{1}_y$. The distance between the centres of adjacent humps 2 at half the hump height in the direction of the y axis is a. The hump plate 1 has a thickness $t_{st}$ while the flat plate 3 has a thickness $t_{al}$. The cavity height between the two plates 1, 3 is h. As the drawing immediately shows, the flat aluminium plate 3 is substantially thicker than the steel hump plate 1, to withstand stressings during operation. As a rule such a light structural plate is so loaded that the thicker aluminium flat plate 3 acts as a pressure chord, the thinner steel hump plate 1 acting as a tension chord.

The following relationships have been found advantageous for the dimensioning of the light structural plate:

$t_{st}$=¼ to 1 $t_{al}$, more particularly=1.3 to 1.⅔ $t_{al}$ 8 h≦a≦12 h

Ratio between the sum of the connected hump end faces and the overall area of the light structural plate=0.06 to 0.13

30 $t_{al}$+$D_{x,y}$≦45 $t_{al}$+$D_{x,y}$

Figure 2:
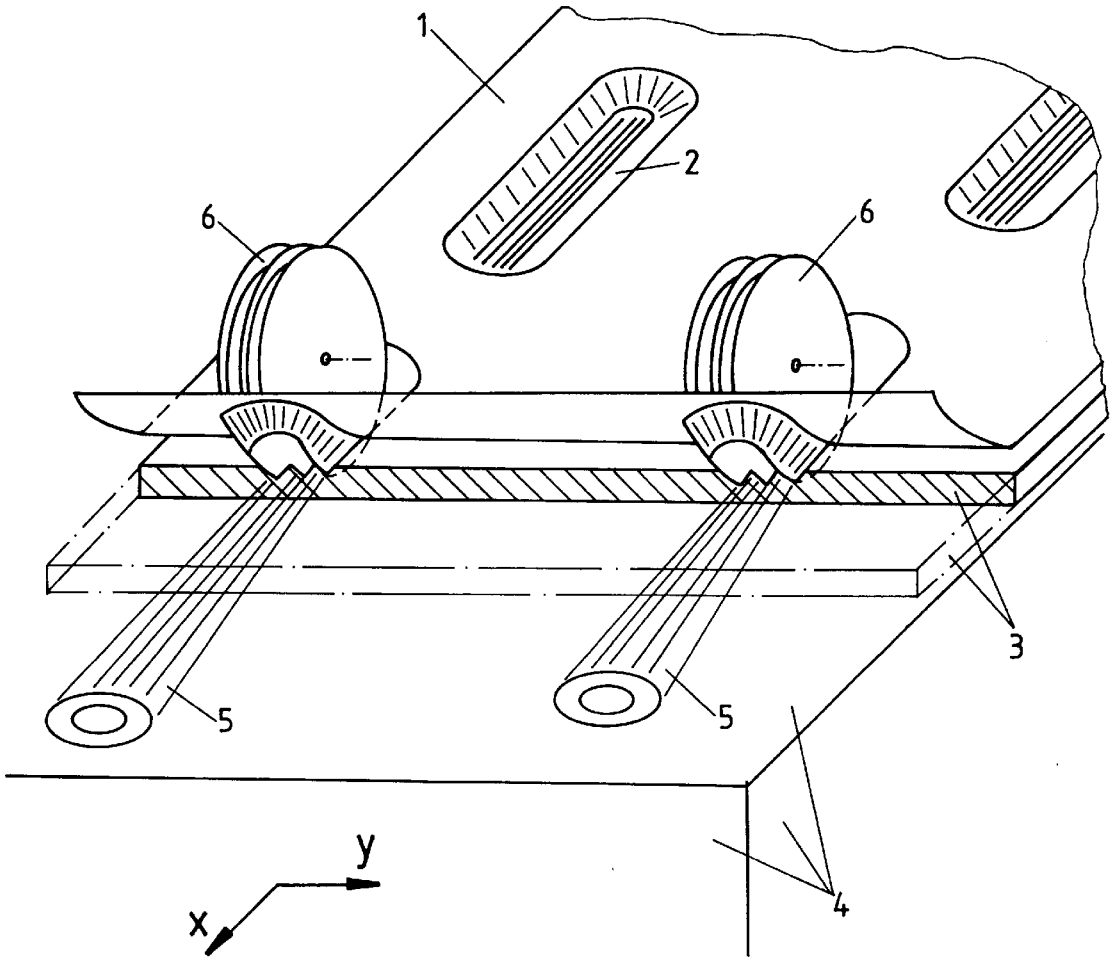
FIG. 2 is the light structural plate illustrated in FIG. 1, shown isometrically during its production.
Figure 3:
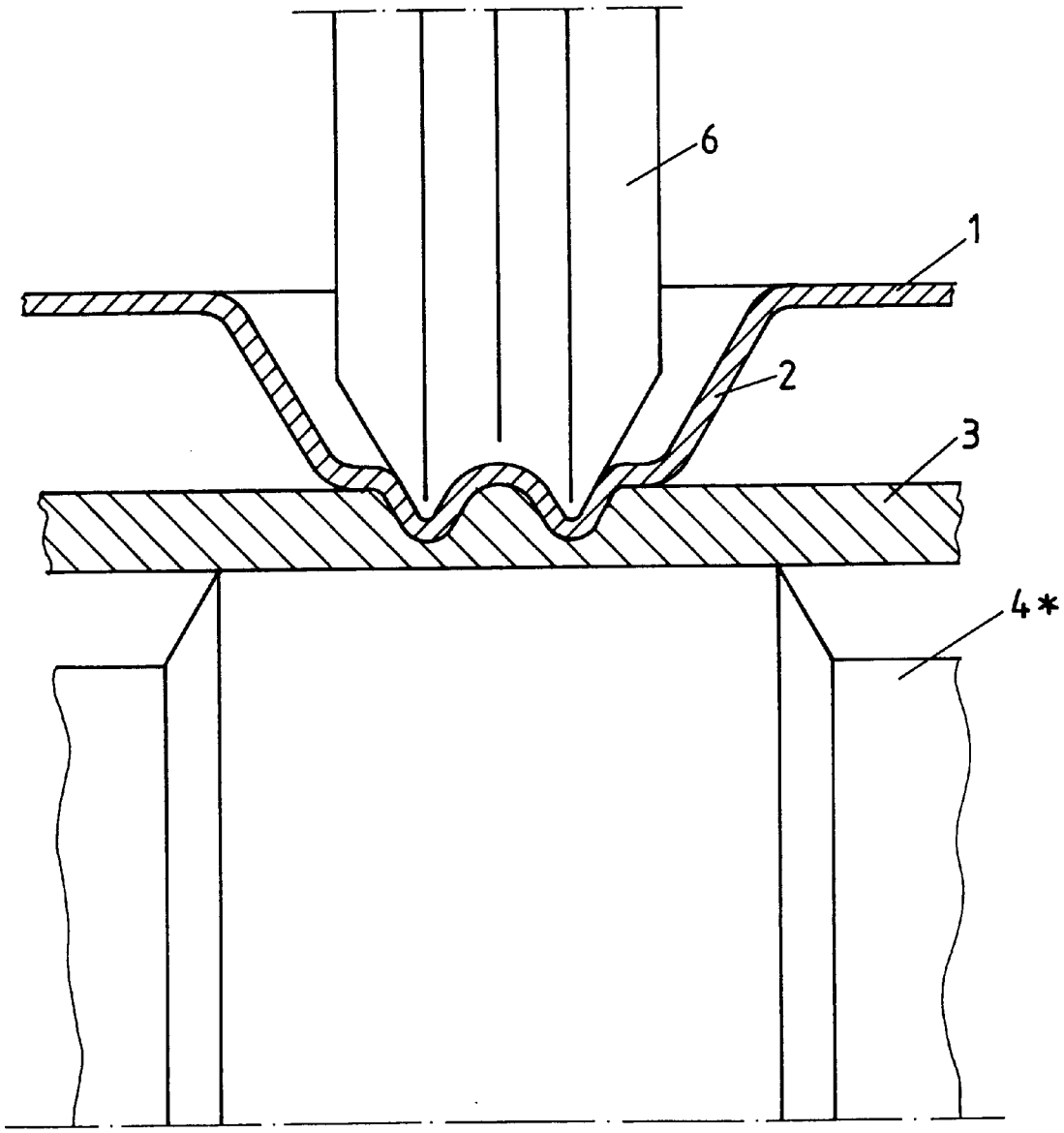
FIG. 3 is a cross-section through a detail of the hump plate shown in FIG. 1 during its production.

In the production of the light structural plate the mould-pressed hump plate 1 is supplied to a roller joining stage as shown in FIGS. 2 and 3. In the roller joining stage, the surfaces of the flat end faces of the humps 2 are activated with a laser beam 5. On the surface, for example, the zinc layer, there must be no melting or even evaporation. In the roller joining stage the hump plate 1 is pressed together with the thicker flat aluminium plate 3, while the laser beam 5 is introduced into the closure joint gap. At the same time, the surface of the flat plate 3 is also activated by the laser beam 5 at the connecting places. The laser used can be a gas or solid laser, but due to its high level of output more particularly a diode laser. The pressing tools used are a flat supporting plate 4 (FIG. 2) acting on the flat plate 3, or a supporting roller 4 having a cylindrical generated surface (FIG. 3) on which the flat plate 3 rests, and profiled pressure rollers 6 acting on the hump plate 1 and entering the humps 2 or a downwardly rolling profiled pressing surface. When the two plates 1, 3 are pressed together, the profiling of the pressure roller 5, formed by grooves and ribs, is transmitted to the end face of the humps 2 and thence to the joint side of the flat aluminium plate 3, the flat plate 3 becoming plastically deformed by 40% at the most and 20% at the least. The special profiling of the pressure rollers 6 in the form of grooves and ribs prevents any undesirable lateral flow of the aluminium material in the plane of the plate. This pressing together under pressure produces both a substance-to-substance and also a positive durable connection.

What is claimed is:

1. A light structural metal plate, comprising:

a hump plate comprised of steel including humps which present hump end faces; and a flat plate comprised of aluminum, said flat plate being connected by a substance-to-substance connection to said hump plate at said hump end faces thereof, remaining portions of said hump plate being spaced apart from the flat plate thereby defining a cavity therebetween, the substance-to-substance connection comprising a metallic connection produced by heat without a molten phase and having a shear strength of more than 15 $N/mm^2$.

2. A light structural metal plate according to claim 1, wherein the hump plate is galvanized at least on a connection side adjacent to said flat plate.

3. A light structural metal plate according to claim 2, wherein a form fitted engagement between the flat plate with the hump plate is further provided in addition to said substance-to-substance connection.

4. A light structural metal plate according to the claim 3, wherein said form fitted engagement is achieved at the hump end faces by interengagement of respective parallel grooves and ribs formed in corresponding positions of the flat plate and the hump plate.

5. A light structural metal plate according to claim 1, wherein the humps present a trapezoidal cross-sectional shape.

6. A light structural metal plate according to claim 1, wherein the humps are greater in length than in width.

7. A light structural metal plate according to claim 1, further comprising a dimensionally stable filling material received in the cavity between the flat plate and the hump plate.

8. A light structural metal plate according to claim 1, a ratio between respective thicknesses of the hump plate $t_{st}$ and the flat plate $t_{al}$ is in a range of about ¼ to about 1.

9. A light structural metal plate according to claim 8, wherein the ratio between respective thicknesses of the hump plate $t_{st}$ and the flat plate $t_{al}$ is in a range of about ⅓ to about 1.⅔.

10. A light structural metal plate according to claim 1, wherein a separation distance of the humps measured at half of a height of the humps are determined by the formula $8\ h \leqq a \leqq 12\ h$, where h is a height of the cavity and a is the separation distance.

11. A light structural metal plate according to claim 1, wherein a ratio between the sum of the connected hump end faces and a total area of the light structural metal plate is in a range of about 0.06 to about 0.13.

12. A light structural metal plate according to claim 1, wherein a distance apart $\mathbf{1}_{x,y}$ of the hump centers in a direction of x and y axes, respectively, is determined by the formula $\mathbf{1}_{x,y} \leqq 45 \cdot t_{al} + D_{x,y}$, where $t_{al}$=material thickness of the flat plate, and $D_{x,y}$ length and width of the hump end face in the direction of the x and y, respectively.

13. A light structural metal plate according to claim 12, wherein the distance apart $\mathbf{1}_{x,y}$ of the hump centers in the direction of the x and y axes, respectively, is determined by the formula $30 \cdot t_{al} + D_{x,y} \leqq \mathbf{1}_{x,y} \leqq 45 \cdot t_{al} + D_{x,y}$.

* * * * *